US005677621A

United States Patent [19]

Bult et al.

[11] Patent Number: 5,677,621

[45] Date of Patent: Oct. 14, 1997

[54] NOISE-INSENSITIVE DEVICE FOR BIAS CURRENT GENERATION

[75] Inventors: Klaas Bult, Los Angeles, Calif.; Godefridus J.G.M. Geelen, Eindhoven, Netherlands

[73] Assignee: U.S. Philips Corporation, New York, N.Y.

[21] Appl. No.: 375,315

[22] Filed: Jan. 18, 1995

[30] Foreign Application Priority Data

Jan. 20, 1994 [BE] Belgium ..... 09400064

[51] Int. Cl.[6] ..... G05F 3/16

[52] U.S. Cl. ..... 323/315; 323/317

[58] Field of Search ..... 323/315, 316, 323/317, 313

[56] References Cited

U.S. PATENT DOCUMENTS

| | | | |
|---|---|---|---|
| 3,982,172 | 9/1976 | Van De Plassche | 323/1 |
| 4,890,010 | 12/1989 | Neudeck et al. | 307/270 |
| 4,941,080 | 7/1990 | Sieborger | 363/127 |
| 4,987,379 | 1/1991 | Hughes | 330/253 |
| 5,132,556 | 7/1992 | Cheng | 307/296 |
| 5,440,277 | 8/1995 | Ewen et al. | 331/176 |

FOREIGN PATENT DOCUMENTS 0531615 3/1993 European Pat. Off. .

*Primary Examiner*—Peter S. Wong
*Assistant Examiner*—Rajnikant B. Patel
*Attorney, Agent, or Firm*—Steven R. Biren

[57] ABSTRACT

A noise-insensitive device for generating a bias current includes a reference voltage source for supplying a reference voltage between a first reference terminal and a second reference terminal. A bias current generator generates the bias current in response to the reference voltage and includes a first and-a second input terminal coupled to the first and the second reference terminal via connecting wires which receive the reference voltage. A first and a second transistor arranged as a differential pair with the gate of the first transistor coupled to the first input terminal and the gate of the second transistor coupled to the second input terminal. The source of the first transistor and the source of the second transistor are coupled to one another at a common terminal for receiving a common current. Each of said transistors has a drain for supplying a first transistor current and a second transistor current, respectively, whose difference decreases when the common current increases. A converter is coupled to the first and the second transistor and has an output terminal for supplying a current which is proportional to the difference between the first transistor current and the second transistor current. A first current mirror has an input branch coupled to the output terminal of the converter. A second current mirror has an input branch coupled to an output branch of the first current mirror and an output branch coupled to the common terminal. The connecting wires do not carry current and interference as a result of cross-talk from other circuits coupled to the connecting wires is suppressed by the differential pair.

13 Claims, 3 Drawing Sheets

NOISE-INSENSITIVE DEVICE FOR BIAS CURRENT GENERATION

BACKGROUND OF THE INVENTION

The invention relates to a device for generating a bias current, comprising:

a reference voltage source having a first reference terminal and a second reference terminal for supplying a reference voltage between the first reference terminal and the second reference terminal;

a bias current generator for generating the bias current in response to the reference voltage, the bias current generator comprising: a first input terminal and a second input terminal coupled to the first reference terminal and the second reference terminal for receiving the reference voltage. Such a device is known from 'inter alia' U.S. Pat. No. 3.982.172. FIG. 1 shows the circuit diagram of this known device. The reference voltage source of the known device is formed by a diode-connected bipolar or unipolar transistor through which a reference current is passed. The base-emitter voltage or the gate-source voltage of the transistor functions as the reference voltage. The bias current generator is formed by one or more current source transistors which are of the same type as the diode-connected transistor and have their base-emitter junctions or gate-source junctions arranged in parallel with the junction of the diode-connected transistor. The diode-connected transistor and the current source transistors are arranged as a current mirror so that there is a fixed relationship between the reference current through the diode-connected transistor and the output currents of the current source transistors. A disadvantage of this known device is that one of the connecting wires between the reference voltage source and the bias current generator is current-carrying and that a voltage drop may be produced in this wire. This applies in particular to the connecting wire between the emitter or source of the diode-connected transistor and the emitters or sources of the current source transistors. In the prior-art device this wire also corresponds to a supply line, which gives rise to additional noise voltages across the wire. The voltage drop in the current-carrying wire introduces an undesired error voltage in the base-emitter voltage or gate-source voltage of the current source transistors and eventually also an undesired error component in the bias currents supplied by the current source transistors. The undesirable error can be considerable, particularly in the case of comparatively large integrated circuits.

FIG. 2 shows an alternative known solution to this problem. The diode-connected transistor and the current source transistors are arranged near one another and the bias currents are applied from the current source transistors to the current-consuming elements by means of separate connecting wires. A disadvantage of this solution is that as many wires are required as there are elements receiving bias current. This requires a large area on an integrated circuit and is undesirable.

SUMMARY OF THE INVENTION

It is an object of the invention to provide a device for generating bias current which is immune to noise and which requires a minimal number of connecting wires. To this end, according to the invention, the device of the type defined in the opening sentence is characterised in that the bias current generator further comprises:

a first transistor and a second transistor which are arranged as a differential pair and which each have a control electrode and a first main electrode, the control electrode of the first transistor being coupled to the first input terminal and the control electrode of the second transistor being coupled to the second input terminal, the first main electrode of the first transistor and the first main electrode of the second transistor being coupled to one another at a common terminal for receiving a common current, each of said transistors having a second main electrode for supplying a first transistor current and a second transistor current, respectively, whose difference decreases when the common current increases;

a converter coupled to the first transistor and the second transistor and having an output terminal for supplying a current which is proportional to the difference between the first transistor current and the second transistor current;

a first current mirror having an input branch coupled to the output terminal of the converter, and having an output branch;

a second current mirror having an input branch coupled to the output branch of the first current mirror, and an output branch coupled to the common terminal.

The proposed solution provides a two-wire distribution system for a reference voltage which is converted into a bias current at the location of the current-consuming element. The two connecting wires are not current-carrying and can be arranged close to one another on a chip. Extraneous influences such as cross-talk from other signals on the chip will then appear as a common-mode signal but the differential pair is immune to such a signal. This results in a high noise immunity.

At option, the first current mirror and the second current mirror may be provided with a plurality of output branches, so that for each bias current generator one or more bias currents are available which refer to the positive or the negative supply voltage. The differential pair, the converter for supplying the difference current, the first current mirror and the second current mirror form a loop whose steady state loop gain is unity at a given reference voltage between the control electrodes of the differential pair. In order to prevent the loop currents from constantly increasing the difference between the currents in the first and the second transistor should decrease as the common current of the first and the second transistor increases. This can be achieved in a first variant, which is characterised in that the first transistor and the second transistor are unipolar field effect transistors each having a gate, a source and a drain, which correspond to the control electrode, the first main electrode and the second main electrode, respectively, the drains of the first and the second transistor being connected to the common terminal. In the case of unipolar (MOS) transistors the transconductance of a differential pair is proportional to the root of the common current, so that the increase in current difference decreases automatically as the common current increases. This is not the case with bipolar transistors so that other measures are required. To this end a second variant is characterised in that the first transistor and the second transistor are bipolar transistors each having a base, an emitter and a collector, which correspond to the control electrode, the first main electrode and the second main electrode, respectively, the emitter of the first transistor being connected to the common terminal via a resistor and the emitter of the second transistor being connected directly to said common terminal. When the common current increases the resistor in the emitter lead of the first transistor will ensure that a comparatively larger portion flows through the second transistor and the difference in collector currents consequently decreases.

The reference voltage is generated centrally and is conveyed to the local bias current generators, where the reference voltage is converted into bias currents. The reference voltage source may be of any type, for example, a voltage divider with two taps, which is connected to a supply voltage. An embodiment which is very suitable for this purpose is characterised in that the reference voltage source comprises:

a second bias current generator similar to the first-mentioned bias current generator, the second current mirror of the second bias current generator having a second output branch coupled to the first input terminal of the second bias current generator;

a reference current source coupled to the second output branch of the second current mirror of the second bias current generator;

a direct voltage source connected between the second input terminal of the second bias current generator and a terminal at a fixed potential; the first reference terminal being connected to the first input terminal of the second bias current generator and the second reference terminal being connected to the second input terminal of the second bias current generator.

With this, the relationship between the bias currents in the local first bias current generator and the reference current from the reference voltage source in the central second bias current generator is only determined by the geometry proportions of the current mirror transistors. This makes it possible to generate bias currents of accurately defined magnitudes during the design of the entire circuit.

BRIEF DESCRIPTION OF THE DRAWINGS

These and other aspects of the invention will be described and elucidated with reference to the accompanying drawings, in which.

DESCRIPTION OF THE PREFERRED EMBODIMENTS

In these Figures like parts or elements bear the same reference labels.

Figure 1:
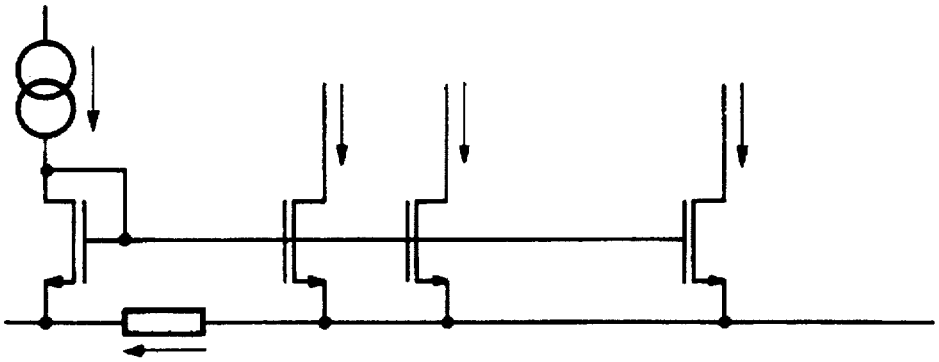
FIG.1 PRIOR ART
FIG. 1 shows a first prior-art device for generating bias currents.
Figure 2:
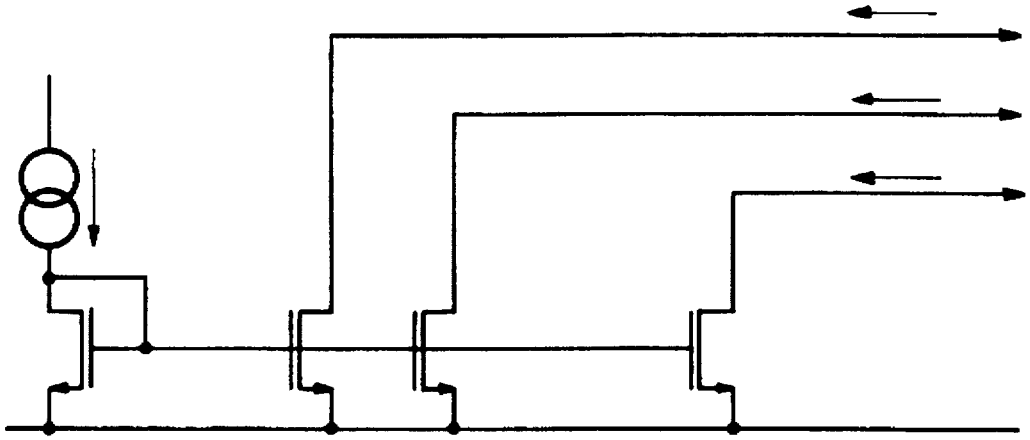
FIG.2 PRIOR ART
FIG. 2 shows a second prior-art device for generating bias currents.
Figure 3:
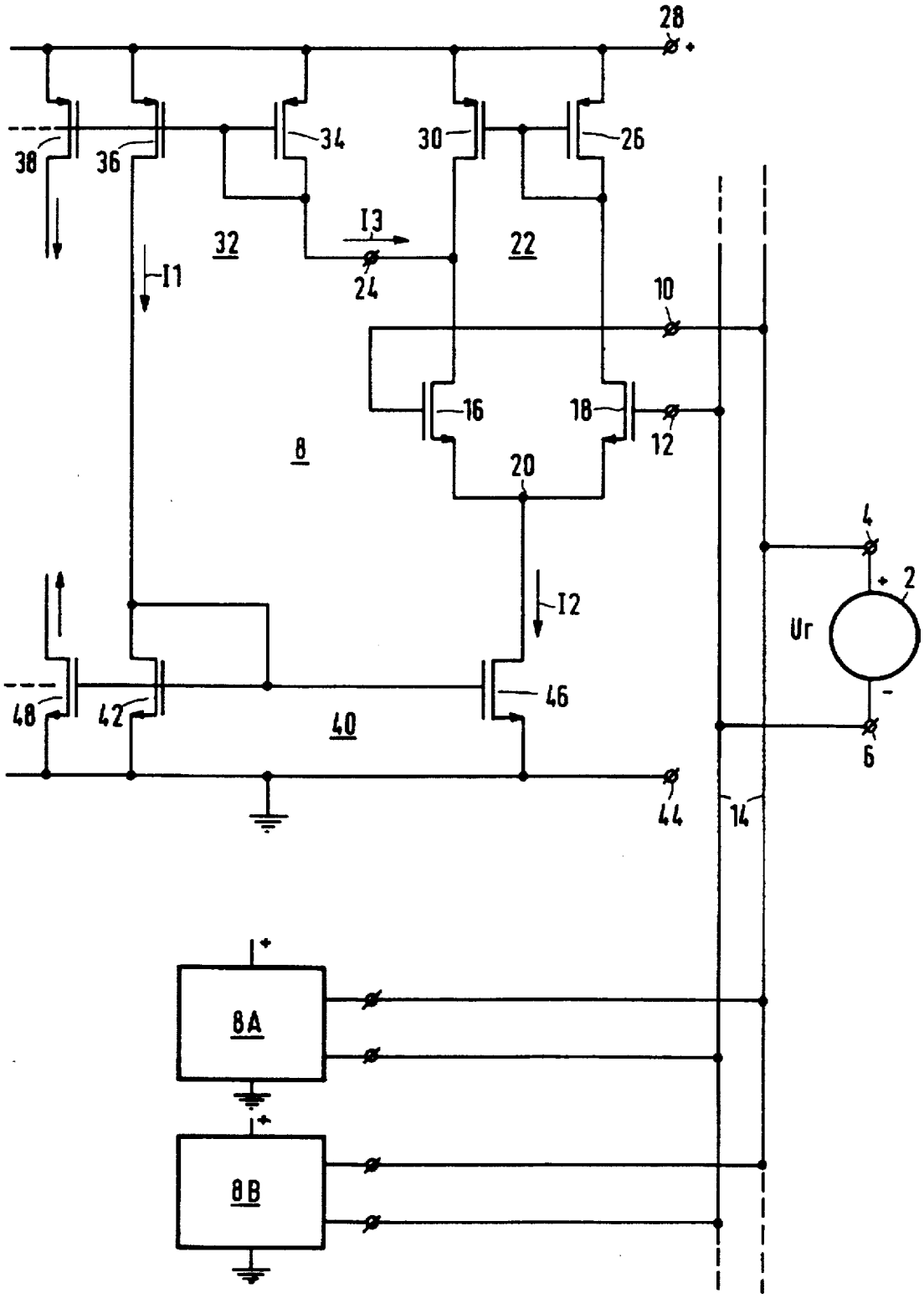
FIG. 3 shows a first variant of a device for generating bias currents in accordance with the invention.

FIG. 3 shows an embodiment of a device for generating bias currents in accordance with the invention. A reference voltage source 2 has a first reference terminal 4 and a second reference terminal 6, between which a reference voltage Ur is produced. The bias currents are generated in a bias current generator 8 having a first input terminal 10 connected to the first reference terminal 4 and having a second input terminal 12 connected to the second reference terminal 6 for receiving the reference voltage Ur from the reference voltage source 2. Likewise, a plurality of bias current generators, referenced 8A and 8B, can be connected to the reference voltage source 2. The reference voltage source 2 is suitably positioned relative to the local bias current generators and is connected to these generators by a two-wire lead 14. The bias current generator 8 comprises an NMOS transistor 16 arranged as a differential pair and having its control electrode or gate connected to the first input terminal 10, and an NMOS transistor 18 having its gate connected to the second input terminal 12. The first main electrodes or sources of the transistor 16 and the transistor 18 are both connected to a common terminal 20 to receive a common current I2. The second main electrodes or drains of the transistor 16 and the transistor 18 are coupled to a converter 22 having an output terminal 24 for supplying a current I3 which is proportional to the difference between the drain currents of the transistor 16 and the transistor 18. The present converter 22 is constructed, by way of example, as a 1:1 current mirror having an input branch formed by a PMOS transistor 26 having its drain and gate short-circuited, having its source connected to a positive supply terminal 28 and having its drain connected to the drain of the transistor 18, and an output branch formed by a PMOS transistor 30 having its source, gate and drain connected to the positive supply terminal 28, the gate of the transistor 26 and the drain of the transistor 16, respectively. The output terminal 24 is connected to the drains of the transistor 16 and the transistor 30 and carries a current I3 equal to the difference between the drain currents of the transistor 16 and the transistor 18. The bias current generator 8 further comprises a B:1 current mirror 32 having an input branch formed by a PMOS transistor 34 having its drain and gate short-circuited, having its source connected to the positive supply terminal 28 and having its drain connected to the output terminal 24, and to an output branch formed by a PMOS transistor 36 whose source and gate are connected to the positive supply terminal 28 and the gate of the transistor 34, respectively. The dimensions of the transistors 34 and 36 have been selected in such a manner that the drain current I1 of the transistor 36 is B times as large as the drain current I3 of the transistor 34. If desired, the current mirror 32 may be provided with at least one additional PMOS transistor 38 whose gate and source are arranged in parallel with the gate and the source of the transistor 36. The bias current generator 8 further comprises an A:1 current mirror 40 having an input branch formed by an NMOS transistor 42 having its drain and gate short-circuited, having its source connected to a negative supply terminal 44 and its drain to the drain of the transistor 36, and to an output branch formed by an NMOS transistor 46 having its source, gate and drain connected to the negative supply terminal 44, the gate of the transistor 42 and the common terminal 20, respectively. The dimensions of the transistors 42 and 46 have been selected in such a manner that the drain current I2 of the transistor 46 is A times as large as the drain current I1 of the transistor 42. If desired, the current mirror 40 may also be provided with at least one additional NMOS transistor 48 whose gate and source are arranged in parallel with the gate and the source of the transistor 46.

The current gain A of the current mirror 40 and the current gain B of the current mirror 32 are linear. However, the current gain I3/I2 is not linear because the transconductance of the NMOS differential pair is proportional to the root of the current I2. The currents flowing in the bias current generator 8 will now be so large that the loop gain is equal to unity. The values of these currents can be adjusted with the reference voltage Ur. The relationship between the current I1 and the reference voltage Ur can be calculated as follows.

$$I1=B\cdot I3 \quad (1)$$

and $$I2=A\cdot I1 \quad (2)$$

From the quadratic relationship between the drain current Id and the gate-source voltage Vgs in accordance with:

$$Id = \frac{\beta}{2}(Vgs - Vt)^2 \quad (3)$$

where Vt is the threshold voltage and β is a transconductance parameter dictated by the geometry and by material constants of the MOS transistor, the following relationship can be derived:

$$I3 = Ur\sqrt{\beta(I2 - (\beta/4)Ur^2)} \quad (4)$$

Substitution of equations (1) and (2) in equation (4) then yields the following expression for the current I1:

$$I1 = \frac{\beta}{2} Ur^2\beta\{AB + \sqrt{((AB)^2 - 1)}\} \quad (5)$$

The circuit is self-starting if AB>1 but when necessary a starting circuit may be provided. The current I1 can now be mirrored further by means of the additional transistors 38 and 48 in order to provide further circuits, not shown, with bias current. From equation (5) it follows that the current I1 is dependent on the reference voltage Ur, on the parameter β and on the current gain factors A and B, which factors are only determined by geometry proportions of transistors.

The two-wire lead 14 picks up interference, which appears as a common mode signal on the gates of the transistors 16 and 18 of the differential pair which is insensitive to such a signal. The gates of the differential pair present hardly any load to the two-wire lead 14, so that there is no voltage drop between the reference voltage source 2 and the bias current generator 8.

Figure 4:
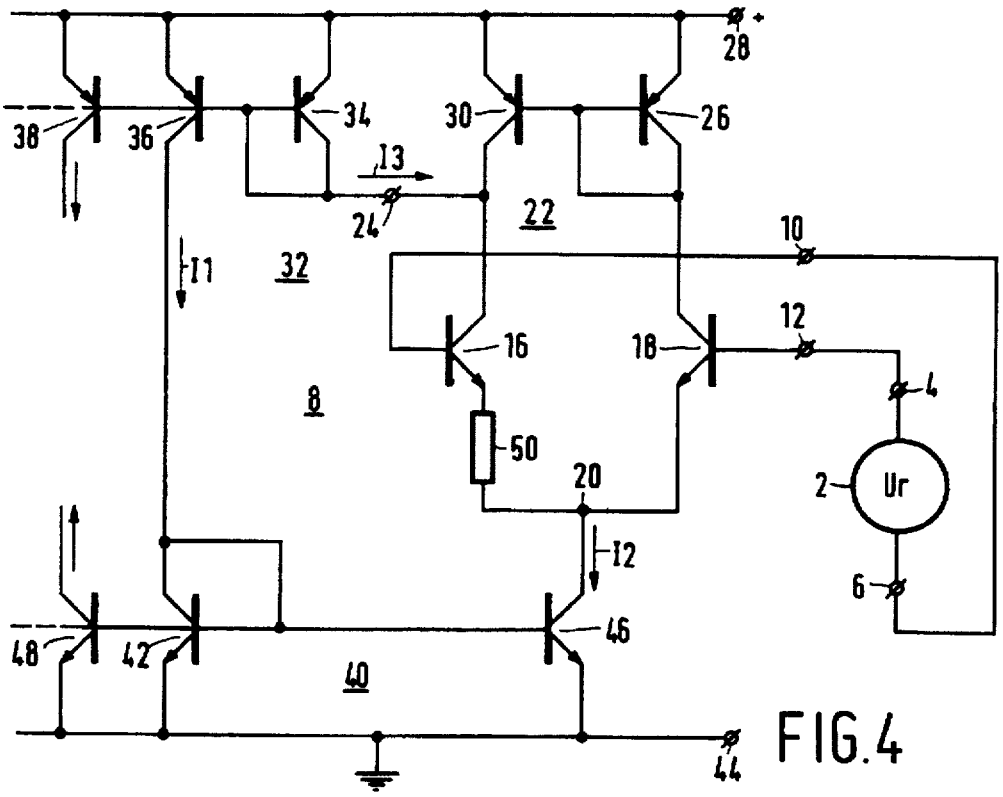
FIG. 4 shows a second variant of a device for generating bias currents in accordance with the invention.

FIG. 4 shows the arrangement of FIG. 3 with bipolar transistors, the control electrode, the first main electrode and the second main electrode now corresponding to the base, the emitter and the collector, respectively. PMOS transistors are replaced by PNP transistors and NMOS transistors by NPN transistors. In order to obtain a non-linear current gain I3/I2 a resistor 50 is arranged in series with the emitter of the bipolar transistor 16. When the current I2 increases a comparatively larger portion of the current I2 will flow through the bipolar transistor 18, so that the difference current I3 will increase to a decreasing extent.

It will be evident that the combined use of unipolar transistors and bipolar transistors is also possible. For example, the transistors 16 and 18 of the differential pair may be NMOS transistors and the current mirrors 22, 32 and 40 may comprise bipolar transistors.

Figure 5:
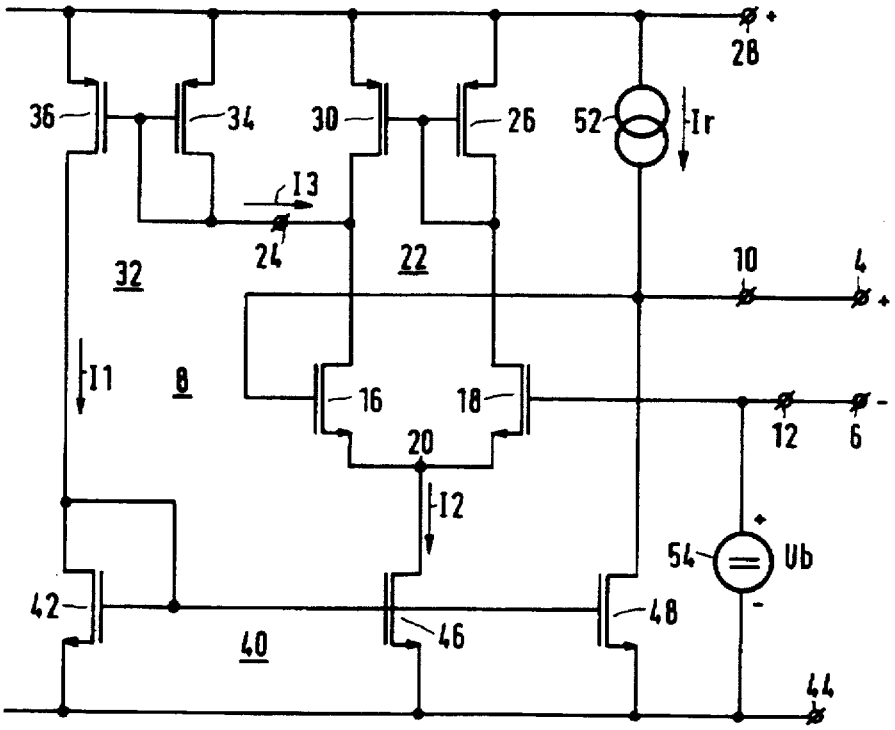
FIG. 5 shows a reference voltage source for use in a device for generating bias currents in accordance with the invention.

The reference voltage source 2 can be constructed by means of any suitable direct voltage source, for example, by means of a voltage divider having two taps, which form the first reference terminal 4 and the second reference terminal 6. A very suitable reference voltage source is shown in FIG. 5. The reference voltage source comprises a bias current generator 8 which is similar to the bias current generator 8 in FIG. 3 but which has the drain of the additional transistor 48 connected to the first input terminal 10 and which further comprises a reference current source 52 connected between the positive supply terminal 28 and the first input terminal 10, and a direct voltage source 54 connected between the second input terminal 12 and the negative supply terminal 44. The first input terminal 10 is connected to the first reference terminal 4 and the second input terminal 12 is connected to the second reference terminal 6.

The reference current source 52 supplies a reference current Ir to the transistor 48 and thereby fixes the value of the current I1 not only in the reference voltage source itself but also in all the reference generators connected via the two-wire lead 14. The reference voltage source 54 provides the second reference terminal 6 with a suitably selected bias voltage. The voltage on the first reference terminal 4 automatically assumes a value for which the reference current Ir can maintain itself in the transistor 48. The bias current generator 8 in FIG. 5 and the bias current generator 8 in FIG. 3 are of similar design and structure and like parts of these generators may be similar to one another. In that case the currents I1, I2 and I3 in the bias current generator 8 of the reference voltage source will be copied to the bias current generators connected via the two-wire lead. When bipolar transistors are used the bias current generator 8 in the reference voltage source shown in FIG. 5 should also be equipped with bipolar transistors.

We claim:

1. A device for generating a bias current, comprising:

a reference voltage source having a first reference terminal and a second reference terminal for supplying a reference voltage between the first reference terminal and the second reference terminal;

a bias current generator for generating the bias current in response to the reference voltage, the bias current generator comprising: a first input terminal and a second input terminal coupled to the first reference terminal (4) and the second reference terminal for receiving the reference voltage, wherein the bias current generator further comprises:

a first transistor and a second transistor connected differential pair and which each have a control electrode and a first main electrode, the control electrode of the first transistor being coupled to the first input terminal and the control electrode of the second transistor being coupled to the second input terminal, the first main electrode of the first transistor and the first main electrode of the second transistor being coupled to one another at a common terminal for receiving a common current, each of said transistors having a second main electrode for supplying a first transistor current and a second transistor current, respectively, whose difference decreases when the common current increases;

a converter coupled to the first transistor and the second transistor and having an output terminal for supplying a current which is proportional to the difference between the first transistor current and the second transistor current;

a first current mirror having an input branch coupled to the output terminal of the converter, and having an output branch;

a second current mirror having an input branch coupled to the output branch of the first current mirror, and an output branch coupled to the common terminal.

2. A device as claimed in claim 1, wherein the reference voltage source comprises:

a second bias current generator similar to the first-mentioned bias current generator, the second current mirror of the second bias current generator having a second output branch coupled to the first input terminal (of the second bias current generator;

a reference current source coupled to the second output branch of the second current mirror of the second bias current generator;

a direct voltage source connected between the second input terminal of the second bias current generator and a terminal at a fixed potential; the first reference terminal being connected to the first input terminal of the second bias current generator and the second reference terminal being connected to the second input terminal of the second bias current generator.

3. A device as claimed in claim 1 or 2, wherein the converter comprises a current mirror having an input branch coupled to the second main electrode of the second transistor and having an output branch coupled to the second main electrode of the first transistor and to the output terminal of the converter.

4. A device as claimed in claim 1, 2 or 3, wherein the first transistor and the second transistor are unipolar field effect transistors each having a gate, a source and a drain, which correspond to the control electrode, the first main electrode and the second main electrode, respectively, the drains of the first and the second transistor being connected to the common terminal.

5. A device as claimed in claim 1, 2 or 3, wherein the first transistor and the second transistor are bipolar transistors each having a base, an emitter and a collector, which correspond to the control electrode, the first main electrode and the second main electrode, respectively, the emitter of the first transistor being connected to the common terminal via a resistor and the emitter of the second transistor being connected directly to said common terminal.

6. A device as claimed in claim 1, wherein the first transistor and the second transistor are unipolar field effect transistors each having a gate, a source and a drain, which correspond to the control electrode, the first main electrode and the second main electrode, respectively, the drains of the first and the second transistor being connected to the common terminal.

7. A device as claimed in claim 1, wherein the first transistor and the second transistor are bipolar transistors each having a base, an emitter and a collector, which correspond to the control electrode, the first main electrode and the second main electrode, respectively, the emitter of the first transistor being connected to the common terminal via a resistor and the emitter of the second transistor being connected directly to said common terminal.

8. A bias current generator comprising:

first and second input terminals coupled to respective first and second terminals of a reference voltage source via first and second connecting conductors, first and second transistors connected as a differential pair with each transistor having a control electrode and first and second main electrodes, the control electrodes of the first and second transistors being coupled to the first and second input terminals, respectively, the respective first main electrodes being coupled to a common terminal for a common current and the respective second main electrodes carrying first and second transistor currents, respectively, whose difference decreases for an increase of the common current, a converter coupled to the first transistor and to the second transistor and having an output terminal for supplying a current which is proportional to the difference between the first transistor current and the second transistor current, a first current mirror having an input branch coupled to the output terminal of the converter, and a second current mirror having an input branch coupled to an output branch of the first current mirror and an output branch coupled to said common terminal.

9. A bias current generator as claimed in claim 8 wherein the converter comprises a third current mirror having an input branch coupled to the second main electrode of the second transistor and having an output branch coupled to the second main electrode of the first transistor and to the output terminal of the converter.

10. A bias current generator as claimed in claim 8 wherein currents I1, I2 and I3 are caused to flow through the output branch of the first current mirror, the common terminal and the converter output terminal, respectively, with the following relationships;

$$I1=BI3 \text{ and } I2=AI1$$

where A and B are the current gain factors of the second and first current mirrors, respectively.

11. A bias current generator as claimed in claim 8 wherein the current in the output branch of the first current mirror is determined by at least the reference voltage and the current gain factors of the first and second current mirrors.

12. A bias current generator as claimed in claim 8 wherein the output terminal of the converter is connected to the second main electrode of the first transistor.

13. A noise-insensitive apparatus for generating at least two bias currents comprising:

first and second bias current generators each as claimed in claim 8 and each having first and second input terminals coupled to respective first and second terminals of said reference voltage source via said first and second connecting conductors, whereby the connecting conductors carry very little current and any cross-talk interference via said connecting conductors is suppressed by the differential pair in each bias current generator.

* * * * *